US007190803B2

(12) United States Patent
van Halteren

(10) Patent No.: US 7,190,803 B2
(45) Date of Patent: Mar. 13, 2007

(54) ACOUSTIC TRANSDUCER HAVING REDUCED THICKNESS

(75) Inventor: Aart Z. van Halteren, Hobrede (NL)

(73) Assignee: Sonion Nederland BV (NL)

( * ) Notice: Subject to any disclaimer, the term of this patent is extended or adjusted under 35 U.S.C. 154(b) by 695 days.

(21) Appl. No.: 10/118,791

(22) Filed: Apr. 9, 2002

(65) Prior Publication Data

US 2003/0190053 A1 Oct. 9, 2003

(51) Int. Cl.
*H04R 9/04* (2006.01)

(52) U.S. Cl. ..... 381/398; 381/418

(58) Field of Classification Search ..... 381/182, 381/186, 380, 381, 398, 417, 418
See application file for complete search history.

(56) References Cited

U.S. PATENT DOCUMENTS

| | | | | | |
|---|---|---|---|---|---|
| 3,502,822 | A * | 3/1970 | Sternfeld et al. | ..... | 381/418 |
| 3,742,156 | A * | 6/1973 | Broersma | ..... | 381/417 |
| 3,935,398 | A * | 1/1976 | Carlson et al. | ..... | 381/417 |
| 4,109,116 | A * | 8/1978 | Victoreen | ..... | 381/318 |
| 4,126,769 | A * | 11/1978 | Broersma | ..... | 381/418 |
| 4,904,078 | A * | 2/1990 | Gorike | ..... | 381/313 |
| 5,193,116 | A | 3/1993 | Mostardo | ..... | 381/68 |
| 5,255,246 | A | 10/1993 | van Halteren | ..... | 367/170 |
| 5,610,989 | A * | 3/1997 | Salvage et al. | ..... | 381/417 |
| 5,649,020 | A | 7/1997 | McClurg et al. | ..... | 381/151 |
| 5,757,947 | A * | 5/1998 | Van Halteren et al. | ..... | 381/417 |
| 5,960,093 | A | 9/1999 | Miller | ..... | 381/324 |
| 6,044,162 | A * | 3/2000 | Mead et al. | ..... | 381/312 |
| 6,078,677 | A * | 6/2000 | Dolleman et al. | ..... | 381/418 |
| 6,322,374 | B1 * | 11/2001 | Comtois et al. | ..... | 439/75 |

FOREIGN PATENT DOCUMENTS

| | | |
|---|---|---|
| EP | 1102517 A2 | 9/2000 |
| WO | WO 95/07014 | 3/1995 |
| WO | WO 0027166 | 5/2000 |

OTHER PUBLICATIONS

International Search Report dated Feb. 27, 2006, 5 pages.

* cited by examiner

*Primary Examiner*—Daniel Swerdlow
(74) *Attorney, Agent, or Firm*—Jenkens & Gilchrist

(57) ABSTRACT

A transducer for a hearing aid includes a housing, a relatively thin membrane having a free end suspended in the housing for vibration in response to a motor. The motor has a coil and a magnet assembly, the coil being mounted in the housing beneath the membrane; the magnet assembly being mounted in the housing coaxially with the coil and to one edge of the membrane.

25 Claims, 6 Drawing Sheets

ACOUSTIC TRANSDUCER HAVING REDUCED THICKNESS

FIELD OF THE INVENTION

The invention relates to miniature receivers used in listening devices, such as hearing aids. In particular, the present invention relates to a receiver having one or more improved constructional features including, but not limited to a reduced thickness.

BACKGROUND OF THE INVENTION

A conventional hearing aid or listening device includes a microphone that receives acoustic sound waves and converts the acoustic sound waves to an audio (frequency) (electrical) signal. That "audio signal" is then processed (e.g., amplified) and sent to the receiver of the hearing aid or listening device. The receiver then converts the processed signal to a corresponding acoustic signal that is broadcast toward the eardrum.

A conventional hearing aid or listening device can include both a microphone and a telecoil for receiving inputs. The telecoil picks up electromagnetic (broadcast) signals. The telecoil produces a signal voltage across its terminals when placed within an electromagnetic field, which is created by an alternating current of an audio frequency electromagnetic signal moving through a wire. The signal in the telecoil is then processed (e.g. amplified) and sent to the transducer (or receiver) of the hearing aid for conversion to a corresponding acoustic signal.

A typical "hearing aid" comprises a combination of a receiver and a microphone in one housing or "case." The signal from the microphone to the receiver is amplified before the receiver broadcasts the acoustic signal toward the eardrum.

In a typical balanced armature receiver, the housing or "case" is made of a soft magnetic material, such as a nickel-iron alloy. The case serves several functions: firstly, its housing provides some level of sturdiness; secondly, it provides a structure for supporting the components and their electrical connections. Thirdly, the case provides both magnetic and electrical shielding. Lastly, the case may provide acoustical and vibrational isolation to the other parts of the hearing aid.

The broadcasting of the acoustic signal causes the receiver to vibrate. The vibrations can affect the overall performance of the listening device. For example, the vibrations in the receiver can be transmitted back to the microphone, causing unwanted feedback. Furthermore, in a hearing aid with a telecoil, a magnetic feedback signal may create feedback problems. Consequently, it is desirable to reduce the amount of vibrations and/or magnetic feedback that occur in the receiver of the hearing aid or listening device.

Presently available moving armature transducers have a minimum thickness, based upon the usual manner of assembly of the various parts. Typical such transducers/receivers are shown in FIGS. 1 and 2. While the receivers 10 and 10*a* shown in FIGS. 1 and 2 are essentially of the same configuration, they differ primarily in the design of the armature, FIG. 1 illustrating a so-called E-type armature 12, and FIG. 2 showing a U-type armature 12*a*. Accordingly, like reference numerals with the suffix "a" are used to designate the like parts and components of the receiver of FIG. 2, whereby the components of the receiver of FIG. 10 will be described in detail, it being understood that the components of the receiver of 10*a* of FIG. 2 are essentially the same.

A housing surrounds the working components of the receiver 10 and includes a case 14 and a cover 15. One end of the housing includes an output port 16 for transmitting the acoustical signal toward the users eardrum. An opposite end of the housing may include an electrical connector assembly 18 which may include provisions for various types of contacts or electrical connections such as by soldering or the like. This connector 18 receives an input audio frequency electrical signal that is converted by the internal working components of the receiver to an output acoustic signal (sound waves) which is broadcast from the output port 16.

The working components of the transducer or receiver 10 include a motor 20 which includes a magnet assembly 22 and a coil 24 which are coaxially located and in side-by-side abutting alignment. Through an axial center of the coil 24 and magnet assembly 22 is a moveable armature 12, which is moved in response to the electromagnetic forces produced by the magnet assembly 22 and coil 24 in response to the applied audio frequency electrical signal at the terminal 18. Thus, the corresponding motion of the armature 12 may be translated into acoustic energy (sound waves) by a diaphragm 30 which is mounted in the case 14 above the magnet assembly 22 and coil 24 and is operatively coupled with the armature 12 by a drive pin 32.

The overall thickness of the receiver 10 is defined by the thickness of the walls of the case 14 and cover 15, the thickness of the magnet assembly 22, which includes a magnet 26 and a magnet housing 28 surrounding the magnet 26, the diaphragm 30 and sufficient free airspace to permit vibration of the diaphragm to create acoustic energy or sound waves in response to the operation of the motor 20 as described above.

In hearing aids, it is generally desirable to decrease overall size of components where possible, and in particular, for hearing aides such as a behind the ear (BTE) hearing aid 40 (see FIG. 3) or "in the ear" (ITE) hearing aid (not shown). The overall width of the hearing aid is essentially determined by the thickness of the receiver.

In the U-type armature, receiver 10*a* of FIG. 2, an additional element to the overall thickness to the receiver is the second arm of the U-shaped armature 12*a* as indicated at reference numeral 12*b*.

SUMMARY OF THE INVENTION

It is a general object of this invention to provide an improved transducer/receiver for a listening device, e.g., a hearing aid.

In accordance with one aspect of the invention, a transducer for a hearing aid comprises a housing, a relatively thin membrane suspended in said housing for vibration in response to a motor, said motor comprising a coil and a magnet assembly, said coil being mounted in said housing beneath said membrane; said magnet assembly being mounted in said housing coaxially with said coil to one edge of said membrane.

In accordance with another aspect of the invention, a dual transducer for a hearing aid comprises a pair of transducers mounted in side-by-side abutting relation, each of said transducers comprises a housing, a relatively thin membrane having a free end and suspended in said housing for vibration in response to a motor, said motor comprising a coil and a magnet assembly, said coil being mounted in said housing beneath said membrane; said magnet assembly being mounted in said housing coaxially with said coil and to one edge of said membrane, wherein each said housing comprises a case and a cover with said membrane being spaced beneath and parallel with said cover and wherein said transducers are mounted with said cases in congruently aligned and abutting condition.

Figure 1:
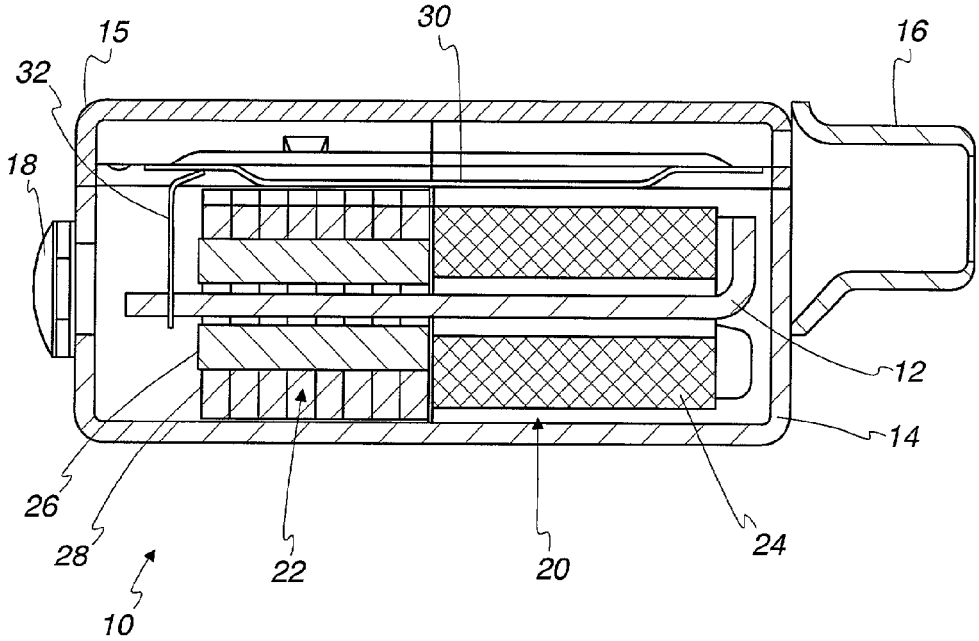
Fig. 1 (Prior Art)
FIG. 1 is a sectional elevation of a prior art receiver.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

Several different embodiments of the invention, each with its own unique features and alternate embodiments, are described. Permutations and combinations of these features will, however, lead to further embodiments.

DETAILED DESCRIPTION OF THE ILLUSTRATED EMBODIMENT

Referring now to the drawings, and initially to FIG. 4, a transducer (receiver) in accordance with the invention is designated generally by the reference numeral 110, and includes generally the same type of components as those described with respect to the transducer/receiver of FIG. 1 hereinabove. Accordingly, like reference numerals with the prefix 1 are used to designate similar parts and components. The receiver is housed in a housing which comprises a case 114 and a cover 116. An armature 112 extends through central openings of a coil 124 and a magnet assembly 122, which together form a motor for driving the armature 112. The magnet assembly 122 is in turn constructed of a magnet 126 surrounded by a magnet housing 128. The armature is connected by way of a drive pin 132 to drive a diaphragm 130 which is spaced between the coil 124 and cover 116 to allow for vibration in response to the action of the motor which in turn is responsive to an incoming electroacoustical or audio frequency electrical signal.

Figure 2:
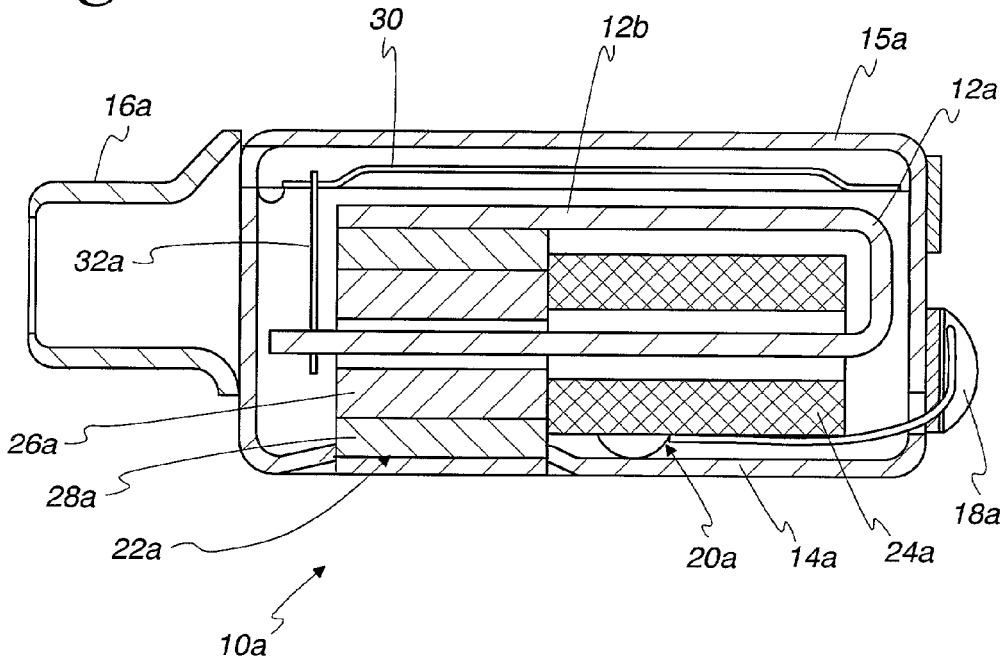
Fig. 2 (Prior Art)
FIG. 2 is a sectional elevation of a second prior art receiver, similar to the receiver of FIG. 1.
Figure 3:
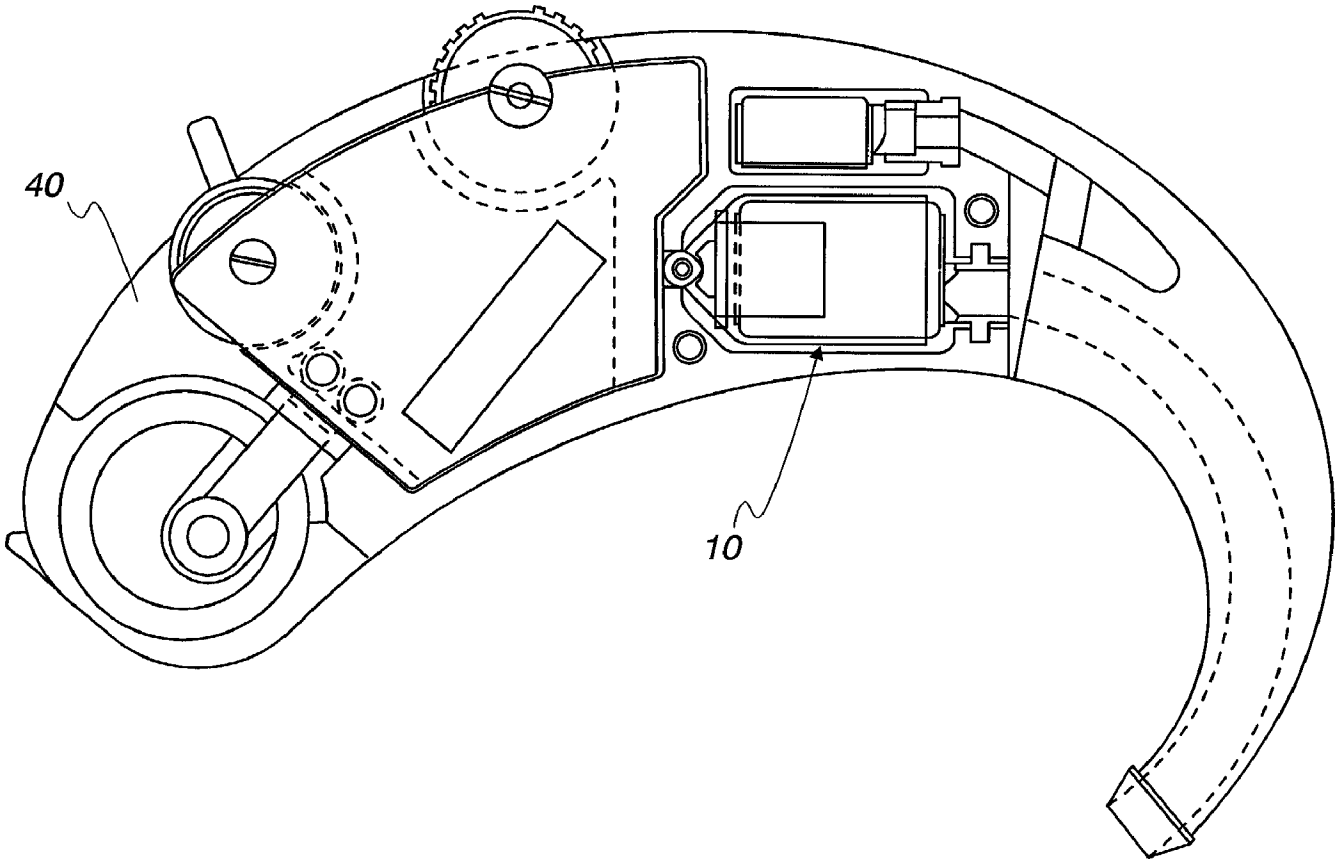
Fig. 3 (Prior Art)
FIG. 3 is a side elevation of an over-the-ear type of hearing aid.

Departing from the embodiments of FIGS. 1 and 2, the magnet assembly 122, rather than being located beneath the diaphragm 130, is located spaced slightly to one side of the diaphragm 130, however, still coaxially aligned with the coil 124. In the embodiment illustrated in FIG. 4, the magnet housing 128 extends into and through an opening 150 provided in registry therewith in the cover 116. However, the cover 116 may be extended outwardly somewhat so as to abut and completely cover the housing 128, in the same fashion as the manner in which the case 114 covers the lower part of the magnet housing 128. In either case, it will be seen that the overall thickness of the transducer 110 of FIG. 4 will be substantially less than that of the assembly of either FIG. 1 or FIG. 2, due to the improved location of the magnet assembly 122. In this regard, the magnet assembly 122 is also spaced laterally from the coil somewhat to create a space through which the drive pin 132 may extend to the diaphragm or membrane 130 to transmit vibrations from the armature, corresponding to the incoming audio frequency electrical signal.

It will be noted that with minimal modification, the transducer 110 can be modified to act as a microphone with an incoming acoustic or sound pressure signal vibrating the membrane 130 and the membrane in turn imparting vibratory motion to the armature causing a corresponding change in the electrical magnetic field of the magnet and coil 120, 124 which can be translated into an electrical output signal. However, the present invention is illustrated and described herein primarily by reference to use of the transducer 110 as a receiver.

Figure 4:
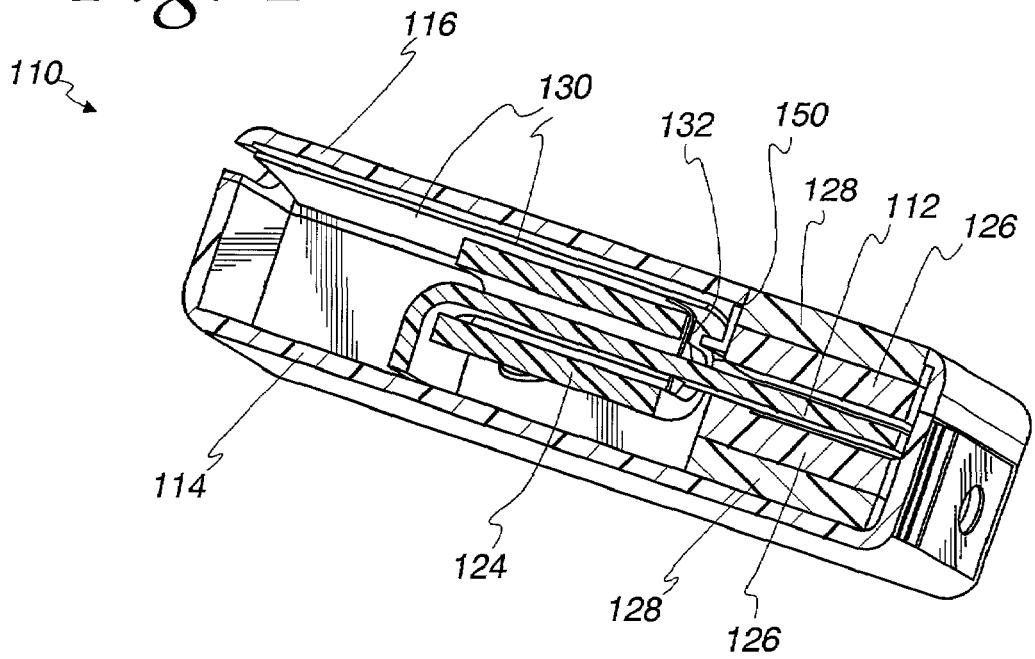
FIG. 4 is an isometric view, partly broken away, illustrating a transducer in accordance with one embodiment of the invention.
Figure 5:
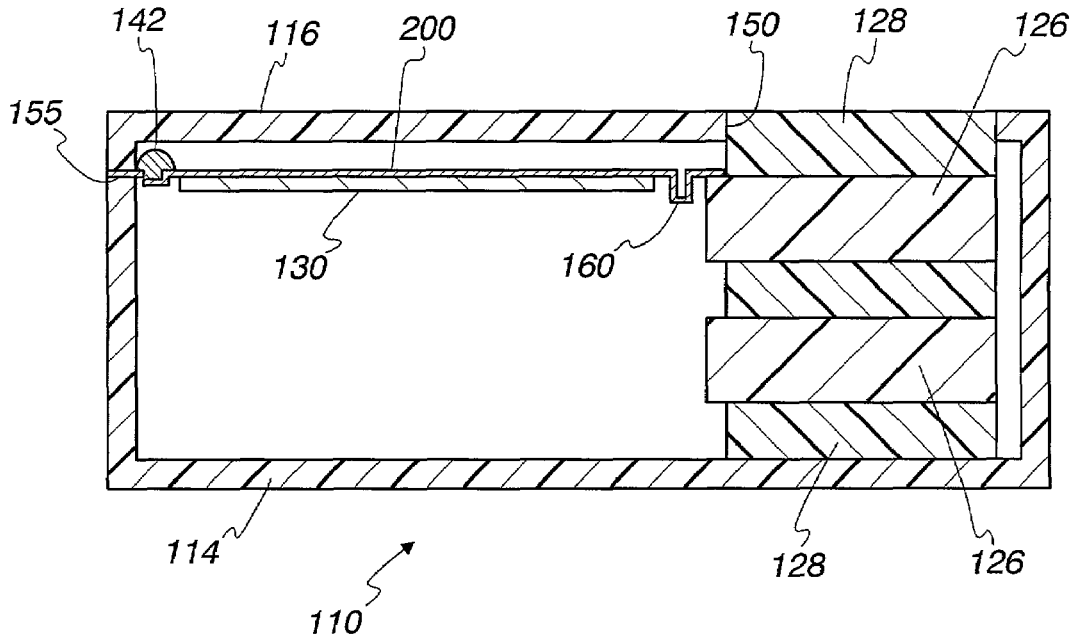
FIG. 5 is a sectional view through a partially assembled transducer showing another embodiment of attaching the membrane to the magnet.

FIG. 5 shows a partially assembled sectional view, similar to the section shown in FIG. 4, of a transducer 110 having a different means of attachment of the membrane. In FIG. 5, the transducer 110 has similar parts and components to the transducer 110 of FIG. 4 in these parts and components are indicated by like reference numerals. Briefly, these components include a case made up of a base 114 and cover 116, a magnet 126 and a magnet housing 128, which in the embodiment shown in FIG. 5 extends flush with a top of the cover 116 through an opening 150 therein. In FIG. 5, the membrane is carried on a foil carrier 200 (as in FIGS. 16–18, described below). The carrier 200 may be clamped between the case 114 and cover 116 about a peripheral edge as indicated generally at reference numeral 155. However, at the embodiment shown in FIG. 5, one edge of the carrier 200 is attached to the magnet 126. In this regard, an additional vibration damping fold 160 is provided adjacent the attachment of the carrier 200 to the magnet 126. The drop or quantity of adhesive 142 for securing the drive pin 132 (not shown in FIG. 5) to the membrane 130 is also shown.

Figure 6:
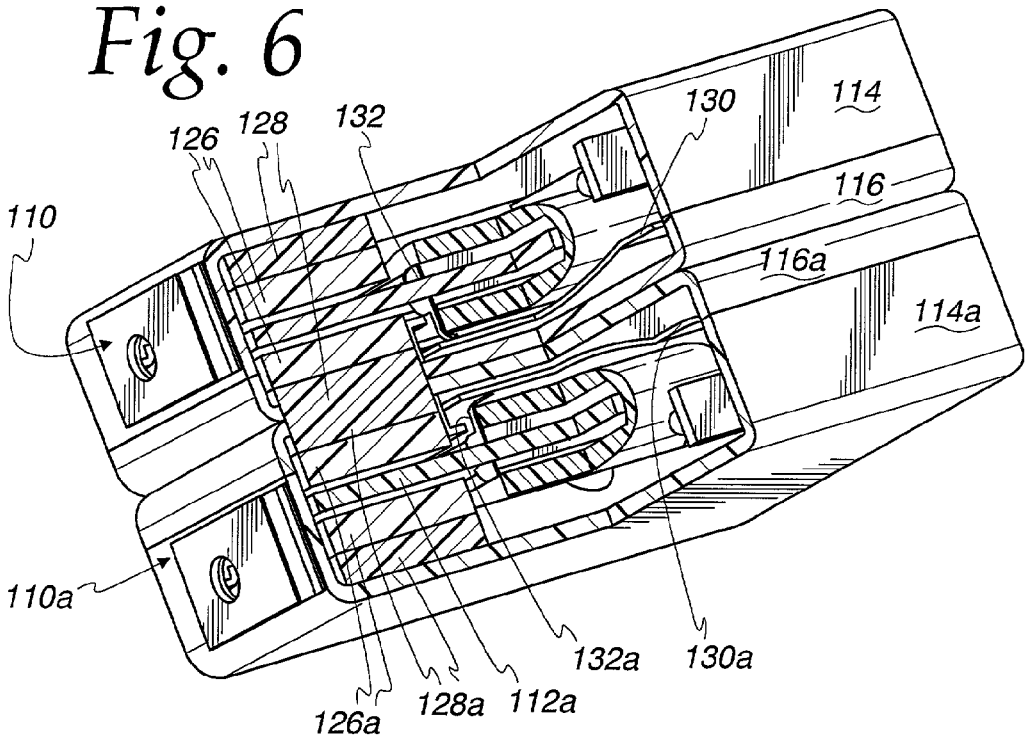
FIGS. 6 and 7 show two embodiments of dual transducers generally utilizing the transducer of FIG. 4.
Figure 7:
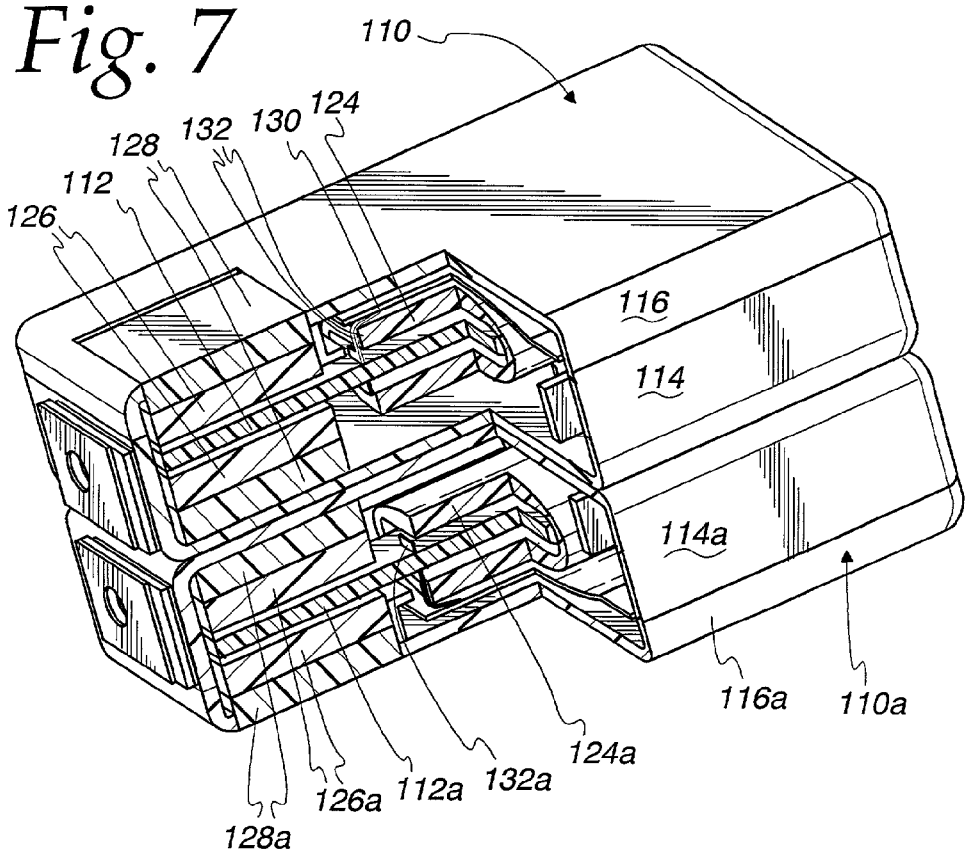

FIGS. 6 and 7 illustrate identical transducers or receivers 110 and 110*a* which are constructed as described with reference to FIG. 4, and mounted in back-to-back alignment. Such dual-use receivers may be utilized to increase the acoustic output in response to an incoming audio frequency electrical signal, in applications where such an increase is desired. Further details of the construction of such dual receivers will be described later. Suffice it to say that in the embodiments of FIGS. 5 and 6 the orientations of the two receivers 110 and 110*a* are respectively reversed, that is, in FIG. 5, the cover portions 116 of the housing are aligned and joined, whereas in the embodiment of FIG. 6 the case portions 114 of the two housings are aligned and joined.

Figure 8A:
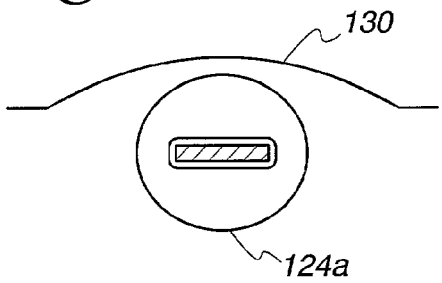
FIGS. 8*a* and 8*b* are two diagrammatic illustrations showing different types of coil.
Figure 8B:
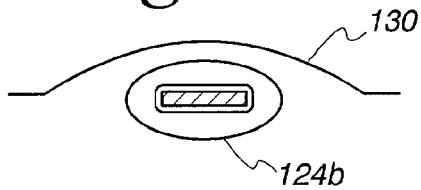

Referring now to FIGS. 8*a* and 8*b*, two embodiments of the coil 124*a* and 124*b* are shown, together with the membrane 130. It will be seen that the membrane 130 is convexly curved to overlie and partially surround an upper (as viewed in FIGS. 8*a* and 8*b*) surface of the coil 124*a*, 124*b*. While the shape of the coil 124*a* is essentially round, the coil 124*b* illustrates a pronounced oval shape. In this regard, either conventional wire or self-bonding type wires may be used to form the coil. When using the self-bonding type, when the coil is heated during production, an adhesive on the wire is caused to melt, when this adhesive then hardens (which takes place in a fraction of a second upon removal of heat energy) the coil is correctly shaped and will not be further deformed during production or assembly. This process may be used for either the circular or oval cross-sectional shapes as shown in FIGS. 8*a* and 8*b*.

Figure 9:
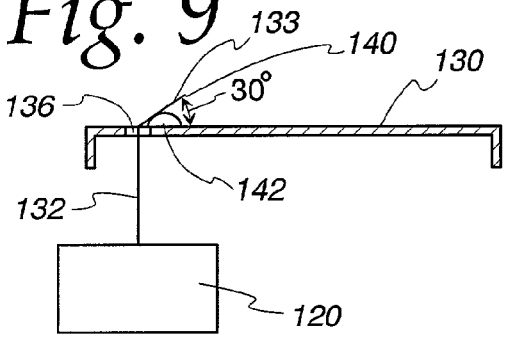
FIG. 9 is a diagrammatic illustration showing attachment of a drive pin to a membrane.

Referring now to FIG. 9, a novel and improved manner of attaching the drive pin 132 to the membrane 130 is shown. In FIG. 9 the drive pin 132 and membrane 130 and also the motor 20 are shown in diagrammatic form for simplicity. The drive pin extends through the membrane 130, by way of a through opening or aperture 136 as shown for example in FIG. 10 or through an edge recess or slot 138 as shown in FIG. 11. At the point where the drive pin 132 emerges from the opening or slot, it is bent over at an acute angle, and the illustrated embodiment, an angle of approximately 30° as indicated by reference numeral 140. A quantity of adhesive 142 is placed between the bent over end 133 of the drive pin 132 and a facing surface of the membrane 130. This permits the glue to or other adhesive to flow relatively naturally into the area between the drive pin end 133 and the facing surface of the membrane 130. This in turn minimizes the chance of the glue spreading into areas of the membrane where it is not intended to.

Figure 10:
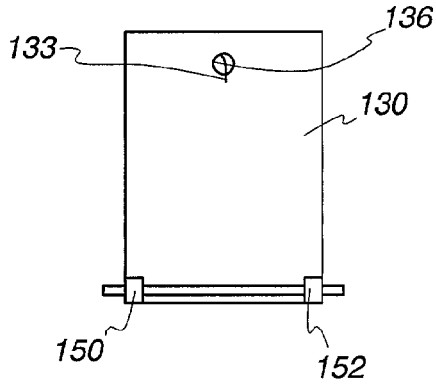
FIGS. 10 and 11 are two diagrammatic representations showing a hinged membrane supported at three points.
Figure 11:
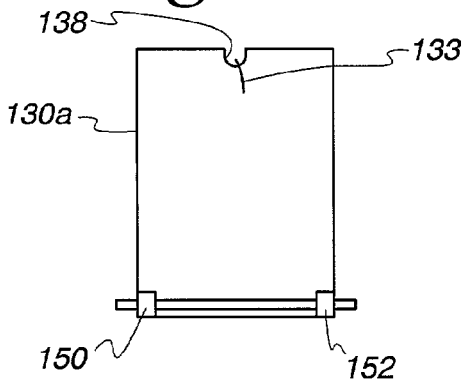

Referring to FIGS. 10 and 11, the membrane 130 with the hole 136 or alternate membrane 130*a* with the edge slot 138 are shown in a novel and improved "three point" driving system. The drive pin forms one point of a triangle and the corners along an opposite edge of the membrane 130 form the other two points, by means of a hinged connection illustrated diagrammatically at 150 and 152 to the case 114 (not shown in FIGS. 10 and 11). This helps in maintaining a proper positioning of the membrane in three dimensions and to achieve as high a compliance as possible.

Figure 12:
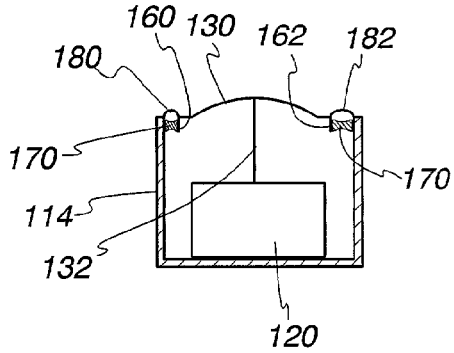
FIGS. 12 and 13 are sectional elevations showing damping of a membrane in diagrammatic form.
Figure 13:
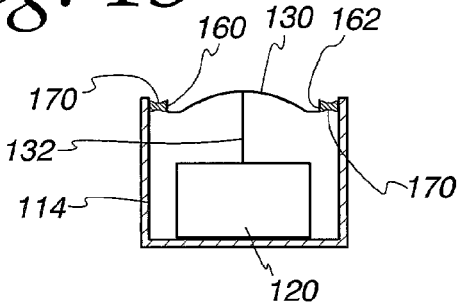

Referring to FIGS. 12 and 13, damping of the membrane may be obtained by the use of damping paste attached between the facing edges of the membrane 130 and the receiver housing or case 114. In the embodiment of FIG. 13 this is achieved by folding or bending over opposite edge portions 160, 162 of the membrane at an angle of 90° and introducing the damping material 170 between these folded up edges and facing inside surfaces of the case 114. In FIG. 12, these opposed edges 160 and 162 of the membrane 30 are folded or bent in the opposite direction and the damping paste is introduced. Also, in FIG. 12, respective caps 180 and 182 are introduced in the area overlying the damping paste 170. Also, in the embodiment shown in FIG. 12, the gap between the facing surfaces of the membrane 130 and case 114 is somewhat wider on one side whereby the corresponding cap 182 is somewhat wider than the cap 180.

Figure 14:
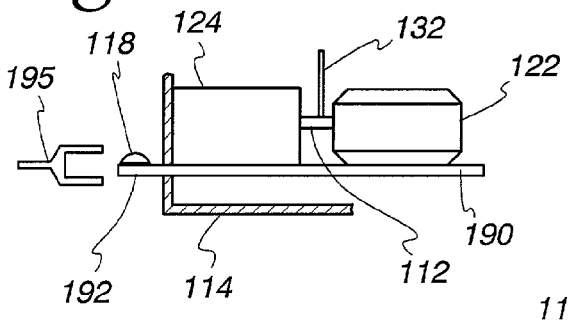
FIGS. 14 and 15 are diagrammatic illustrations showing a coil and magnet assembly mounted to a printed circuit board respectively in a transducer and a dual transducer.
Figure 15:
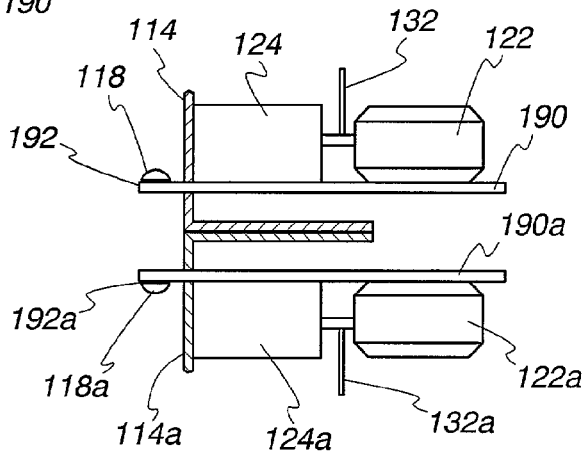

Referring now to FIGS. 14 and 15, in one embodiment, the coil 124 and magnet assembly 122 are mounted on a printed circuit board (PCB) 190. The use of the PCB 190, which provides a relatively rigid planar surface, allows precise positioning of the coil and magnet in aligned, spaced apart and coaxial condition, whereby the armature 112 and drive pin 132 can also be more precisely positioned. The PCB 190 may be supported by the case 114 and may extend therethrough at one end as indicated at reference numeral 192 to define the connector or soldering pad 118 which may be coupled to receive the incoming audio frequency electrical signal by means of a connector 195. The same structural features are shown in FIG. 15 for a dual receiver or dual transducer assembly of the type shown in FIG. 7. Also, by use of the PCB, the leads of the coil can be soldered or welded to the PCB and the leads of the coil can be prepped prior to direct soldering or welding to the PCB or alternatively prepped and lead outwardly of the housing for external connection. The coil and magnet may be partially covered by epoxy resin (not shown) to protect the wires from oxidation and provide added mechanical strength. Also, the PCB permits the addition of other components, such as an amplifier to create an integrated transducer/amplifier or receiver or receiver/amplifier.

Figure 16:
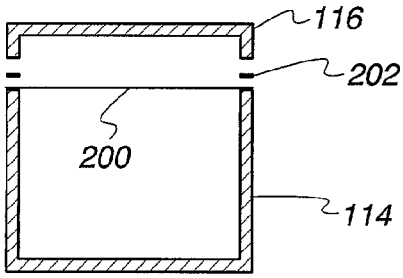
FIGS. 16–18 are three similar, simplified sectional views illustrating different manners of clamping a suspension foil between a case and a cover.
Figure 17:
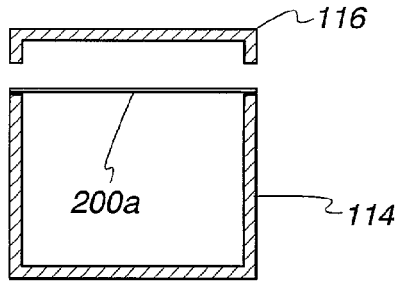
Figure 18:
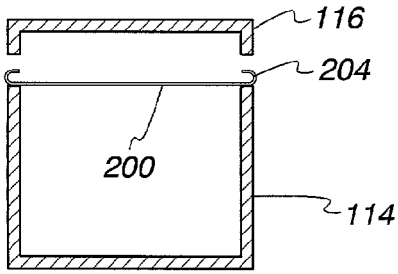

Referring now to FIGS. 16–18, there is shown diagrammatically several ways of attaching a foil 200, which acts as a carrier for the membrane 130, to the housing. In FIG. 17, a foil of increased thickness (that is, compared to the thickness of foil usually used) is clamped directly between the case 114 and cover 116. In FIGS. 16 and 18, a foil of conventional thickness is utilized. In order to provide increased thickness in the area where the foil 200 is clamped between the case 114 and cover 116, two different schemes are shown. In FIG. 16, an extra, relatively thin strip or "ring" 202 of the same foil material is interposed about the periphery of the foil 200. In FIG. 18, a similar effect is achieved by using a foil 200 of increased area and bending or folding back edges thereof as indicated at 204 to create a double layer in the area where the foil is clamped between the cover 16 and case 114. In the embodiments of FIGS. 16 and 18, the extra foil material 202, 204 is interposed between the foil 200 and the cover 116, although this layer might be interposed between the foil 200 and the base 114, if desired. The embodiment of FIGS. 16–18 allow the foil to be attached to the case in such a way as to seal the contents of the case, and provide an air tight motor chamber, without using any glue or other adhesive.

In one embodiment of the invention, the magnet assembly 122 may be further improved by constructing the magnet 126 of a rare earth magnet material such as neodymium or samarium. The specifications of these materials are such that the same amount of magnetic flux can be achieved using less magnetic material, which further allows a decrease of the dimensions of the magnet and magnet housing assembly.

Referring again to FIGS. 6 and 7, a number of considerations arise when using a dual transducer or dual receiver configuration. Firstly, it is difficult or impossible to compensate for lateral movements or vibrations of the receiver, that is, in a plane transverse to the plane of vibration of the membrane. In this regard, U-shaped armatures tend to have greater lateral movements, compared to an E-shaped armature which tends to work more or less like a cantilever. Any rotational movement or vibration can only be compensated when the center of the rotation is the same, or reduced by placing the centers as close together as possible. In practice, this means that a dual receiver will preferably be built with E-type armatures and configured as shown in FIG. 7 in a back-to-back configuration which places the centers of rotation closer together than in the configuration shown in FIG. 6.

Dual receivers are commonly matched by magnetizing one or both in such a way that the sensitivities match at a certain frequency, usually 1 KHz or lower. For optimum performance, the receiver should be matched for output at a peak frequency or other predetermined frequency. This can be done by sorting the receivers into groups and selecting matching receivers according to the foregoing and/or other predefined criteria. The configuration wherein the magnet housing extends through the cover also helps in magnetizing the receivers for matching purposes, otherwise it would have to be done with the covers removed. Advantageously, in the embodiment of FIG. 7, with the mounting of the magnet and coil to the PCB, there is sufficient stability to magnetize with a temporary case or plate to close the bottom. After magnetizing, this dummy cover or plate can be removed and the two cases can be welded together. Also, the PCBs with their connecting pads are much closer together in this configuration which permits them to be integrated into a single electrical connector, for example, so that a single micro push-on or micro socket connector such as the connector 195 can be used.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A transducer for a hearing aid, said transducer comprising:

a housing, a membrane suspended in said housing for vibration in response to a motor having a free end, said motor comprising a coil and a magnet assembly, said coil being mounted in said housing beneath said membrane;

said magnet assembly being mounted in said housing coaxially with said coil and to one edge of said membrane, wherein said magnet assembly is laterally spaced from an end of said coil, and further including an armature extending through said coil and said magnet and a drive pin having one end coupled to said armature and extending through a space defined between said coil and said magnet assembly and having a second end coupled with said membrane, wherein said drive pin extends through said membrane and is bent at an acute angle relative to a surface of said membrane, and wherein a quantity of adhesive is introduced between said membrane surface and said drive pin.

2. The transducer of claim 1 wherein said housing has a case and a cover and wherein said membrane is suspended beneath said cover.

3. The transducer of claim 2 wherein said cover has a through opening and wherein said magnet assembly includes a magnet and a magnet housing surrounding said magnet, a top portion of said magnet housing extending into said opening in said cover.

4. The transducer of claim 3 wherein said magnet is constructed of a rare earth magnet material, wherein the rare earth magnet material includes neodymium or samarium.

5. The transducer of claim 2 wherein said membrane is carried on a suspension foil, and wherein said suspension foil is clamped between said cover and said case.

6. The transducer of claim 5 wherein additional foil is interposed between said cover and said suspension foil along edges of said suspension foil which are clamped between said cover and said case.

7. The transducer of claim 5 wherein outer edges of said suspension foil are folded back to provide a double layer of foil along said edges prior to clamping said edges between said cover and said case.

8. The transducer of claim 1 wherein said coil comprises an oval coil.

9. The transducer of claim 1 wherein said membrane is hingedly coupled with said housing.

10. The transducer of claim 9 wherein said membrane has a through opening through which said drive pin extends.

11. The transducer of claim 9 wherein said membrane has an edge recess through which said drive pin extends.

12. The transducer of claim 1 wherein said coil and said magnet assembly are mounted to a printed circuit board.

13. The transducer of claim 12 wherein an end part of said printed circuit board extends outwardly of said housing to accommodate electrical connecting means.

14. The transducer of claim 13 wherein said electrical connecting means comprises a micro-socket connector.

15. The transducer of claim 1 wherein said housing comprises a case and a cover, and further including flanges formed at lateral edges of said membrane and a quantity of damping paste applied between said flanges and each of a pair of respective opposed inwardly facing surfaces of said case.

16. The transducer of claim 15 wherein said membrane flange on one lateral edge is spaced from the facing wall of said case by a distance greater than the flange on the other edge, wherein said flanges extend into said case and further including a cap applied over said damping paste and along both of the lateral edges of said membrane.

17. The transducer of claim 1 wherein said one edge of said membrane is attached to said magnet assembly.

18. A transducer for a hearing aid, said transducer comprising a housing, a membrane having a free end suspended in said housing for vibration in response to a motor, said motor comprising a coil and a magnet assembly, said coil being mounted in said housing beneath said membrane; said magnet assembly being mounted in said housing coaxially with said coil and to one edge of said membrane, such that said membrane extends over said coil, but not over said magnet assembly.

19. The transducer of claim 18 wherein said one edge of said membrane is attached to said magnet assembly.

20. A dual transducer for a hearing aid, said dual transducer comprising a pair of transducers mounted in side-by-side abutting relation, each of said transducers comprising:

a housing, a membrane having a free end suspended in said housing for vibration in response to a motor, said motor comprising a coil and a magnet assembly, said coil being mounted in said housing beneath said membrane; said magnet assembly being mounted in said housing coaxially with said coil and to one edge of said membrane, such that said membrane extends over said coil, but not over said magnet assembly;

wherein each said housing comprises a case and a cover with said membrane being spaced beneath and parallel with said cover and wherein said transducers are mounted with said cases in congruently aligned and abutting condition.

21. The transducer of claim 20 wherein said one edge of said membrane is attached to said magnet assembly.

22. A transducer for a hearing aid, said transducer comprising:

a housing, a membrane suspended in said housing for vibration in response to a motor having a free end, said motor comprising a coil and a magnet assembly, said coil being mounted in said housing beneath said membrane;

said magnet assembly being mounted in said housing coaxially with said coil and to one edge of said membrane, wherein said housing comprises a case and a cover, and further including flanges formed at lateral edges of said membrane and a quantity of damping paste applied between said flanges and each of a pair of respective opposed inwardly facing surfaces of said case.

23. The transducer of claim 22, wherein said membrane flange on one lateral edge is spaced from the facing wall of said case by a distance greater than the flange on the other edge, wherein said flanges extend into said case and further including a cap applied over said damping paste and along both of the lateral edges of said membrane.

24. A transducer for a hearing aid, said transducer comprising:

a motor comprising a coil and a magnet assembly;

a housing comprising a case and a cover; and a membrane having a free end, said membrane being suspended in said housing for vibration in response to said motor, said membrane further including flanges formed at lateral edges of said membrane and a quantity of damping paste applied between said flanges and each of a pair of respective opposed inwardly facing surfaces of said case, said membrane flange on one lateral edge is spaced from the facing wall of said case by a distance greater than the flange on the other edge, said flanges extend into said case and further including a cap applied over said damping paste and along both of the lateral edges of said membrane, wherein said coil of said motor is mounted in said housing beneath said membrane and said magnet assembly is mounted in said housing coaxially with said coil and to one edge of said membrane.

25. A transducer for a hearing aid, said transducer comprising:

a housing, a membrane suspended in said housing for vibration in response to a motor having a free end, said motor comprising a coil and a magnet assembly, said coil being mounted in said housing beneath said membrane;

said magnet assembly being mounted in said housing coaxially with said coil and to one edge of said membrane, wherein said housing has a case and a cover and said membrane is suspended beneath said cover, wherein said membrane is carried on a suspension foil and said suspension foil is clamped between said cover and said case, and wherein outer edges of said suspension foil are folded back to provide a double layer of foil along said edges prior to clamping said edges between said cover and said case.

* * * * *